US005957111A

United States Patent [19]

Rodier

[11] Patent Number: 5,957,111

[45] Date of Patent: Sep. 28, 1999

[54] METHOD OF REGULATING SUPPLY PRESSURE IN A HYDRAULICALLY-ACTUATED SYSTEM

[75] Inventor: William J. Rodier, Metamora, Ill.

[73] Assignee: Caterpillar Inc., Peoria, Ill.

[21] Appl. No.: 09/039,800

[22] Filed: Mar. 16, 1998

[51] Int. Cl.[6] ..... F02M 41/00

[52] U.S. Cl. ..... 123/458; 123/506; 123/446

[58] Field of Search ..... 123/458, 510, 123/511, 446, 447, 506

[56] References Cited

U.S. PATENT DOCUMENTS

| | | | |
|---|---|---|---|
| 5,121,730 | 6/1992 | Ausman et al. | 123/467 |
| 5,143,291 | 9/1992 | Grinsteiner | 239/88 |
| 5,191,867 | 3/1993 | Glassey | 123/446 |
| 5,271,371 | 12/1993 | Meints et al. | 123/446 |
| 5,313,924 | 5/1994 | Regueiro | 123/458 |
| 5,357,929 | 10/1994 | McCandless | 123/446 |
| 5,421,359 | 6/1995 | Meister et al. | 137/12 |
| 5,485,820 | 1/1996 | Iwaszkiewicz | 123/458 |
| 5,499,608 | 3/1996 | Meister et al. | 123/467 |
| 5,685,273 | 11/1997 | Johnson et al. | 123/506 |
| 5,727,525 | 3/1998 | Tsuzuki | 123/458 |
| 5,758,626 | 6/1998 | Maley | 123/458 |

*Primary Examiner*—Thomas N. Moulis
*Attorney, Agent, or Firm*—Michael B. McNeil

[57] ABSTRACT

A method of regulating pressure in a hydraulically-actuated fuel injection system is described. The hydraulically-actuated fuel injection system includes a high pressure pump coupled to an engine and connected to a high pressure rail. The rail is connected to a plurality of hydraulically-actuated fuel injectors that each include a control valve. The control valve of the individual injectors are periodically activated in a conventional manner sufficiently to perform injection events. At the same time, an electronic control module continues to determine the magnitude of fluid pressure in the high pressure rail. The electronic control module also identifies any idle fuel injectors that are between injection events. If the fluid pressure in the rail is too high, then the control valve of an idle fuel injector is activated for a pressure regulation event that is insufficient for the idle fuel injector to inject fuel, but sufficient to allow some fluid pressure from the rail to escape through the control valve of the injector to a low pressure drain.

20 Claims, 3 Drawing Sheets

RATED
IDLE
50
40
52
51
41
ON
OFF
SOLENOID STATE
TIME 42
54
55
53
43
OPEN
CLOSED
CONTROL VALVE POSITION
TIME 56
44
MAX
0
INJECTION MASS FLOW RATE
TIME

METHOD OF REGULATING SUPPLY PRESSURE IN A HYDRAULICALLY-ACTUATED SYSTEM

TECHNICAL FIELD

The present invention relates generally to hydraulically-actuated systems used with internal combustion engines, and more particularly to a method of regulating the high pressure fluid supply for hydraulically-actuated devices in such a system.

BACKGROUND ART

In order to improve efficiency, control and performance of internal combustion engines, there has been a trend in the industry to adopt hydraulically-actuated electronically controlled systems in place of the cam driven systems long known in the art. For instance, Caterpillar, Inc. of Peoria, Ill. has observed considerable success by substituting its hydraulically-actuated electronically controlled fuel injection systems into diesel engines in place of the cam driven fuel injectors of the prior art. These hydraulically-actuated fuel injectors typically employ engine lubricating oil that is raised to a relatively high pressure as the hydraulic actuating medium. In many instances, a plurality of hydraulically-actuated fuel injectors are connected to single high pressure rail containing pressurized lubricating oil. In order for the hydraulically-actuated system to perform as expected, there must typically be some means provided for controlling the magnitude of fluid pressure in the high pressure common rail.

In the case of Caterpillar, Inc. hydraulically-actuated fuel injection systems, the high pressure common rail is maintained in a pressurized state by a swash plate type pump that is coupled directly to the engine. The fluid demands on the common rail increase with engine speed and load since the fuel injectors are required to inject a larger amount of fuel at higher engine operating conditions. By correctly sizing the high pressure pump and coupling the same directly to the engine, the output of the pump can be made to satisfy the demand of the fuel injectors over the operating range of the engine. However, in order to insure that there is adequate pressure at all times, the high pressure pump is generally sized to produce more high pressure fluid than is required across the engine's operating range. Since the high pressure pump is constantly producing more high pressure fluid than the fuel injectors use in their normal operation, an electronically controlled rail pressure control valve continuously drains an amount of pressurized fluid from the rail to maintain the common rail at a desired pressure.

Those skilled in the art will appreciate that draining pressurized fluid from the common rail without obtaining useful work, results in a waste of energy and a decrease in the overall efficiency and performance of the engine. The use of an electronically controlled rail pressure control valve is also less than desirable in that it requires a separate actuator and control logic. Furthermore, since the prior art pressure regulation system requires an oversized pump, there also remains room for improvement in having an ability to more closely match the output of the high pressure pump to the demands of the hydraulically-actuated fuel injection system.

The present invention is directed to improving upon hydraulically-actuated systems of the prior art.

DISCLOSURE OF THE INVENTION

A method of regulating pressure in a hydraulically-actuated system exploits the idle time of the hydraulically-actuated device to regulate pressure in the high pressure rail. The hydraulically-actuated system has a high pressure pump coupled to an engine and connected to the high pressure rail. The rail is connected to a hydraulically-actuated device that includes a control valve. In its normal operation, the control valve is periodically activated sufficiently to operate the hydraulically-actuated device for an operation event, such as a fuel injection event. The fluid pressure in the high pressure rail is determined. If this fluid pressure is too high and the hydraulically-actuated device is between operation events, then the control valve is activated for a pressure regulation event that is insufficient for the hydraulically-actuated device to perform a minimum operation event. During the pressure regulation event, an amount of fluid from the high pressure rail is allowed to escape through the hydraulically-actuated device, but without having the device actually perform its normal operation, such as injecting fuel.

BEST MODE FOR CARRYING OUT THE INVENTION

Figure 1:
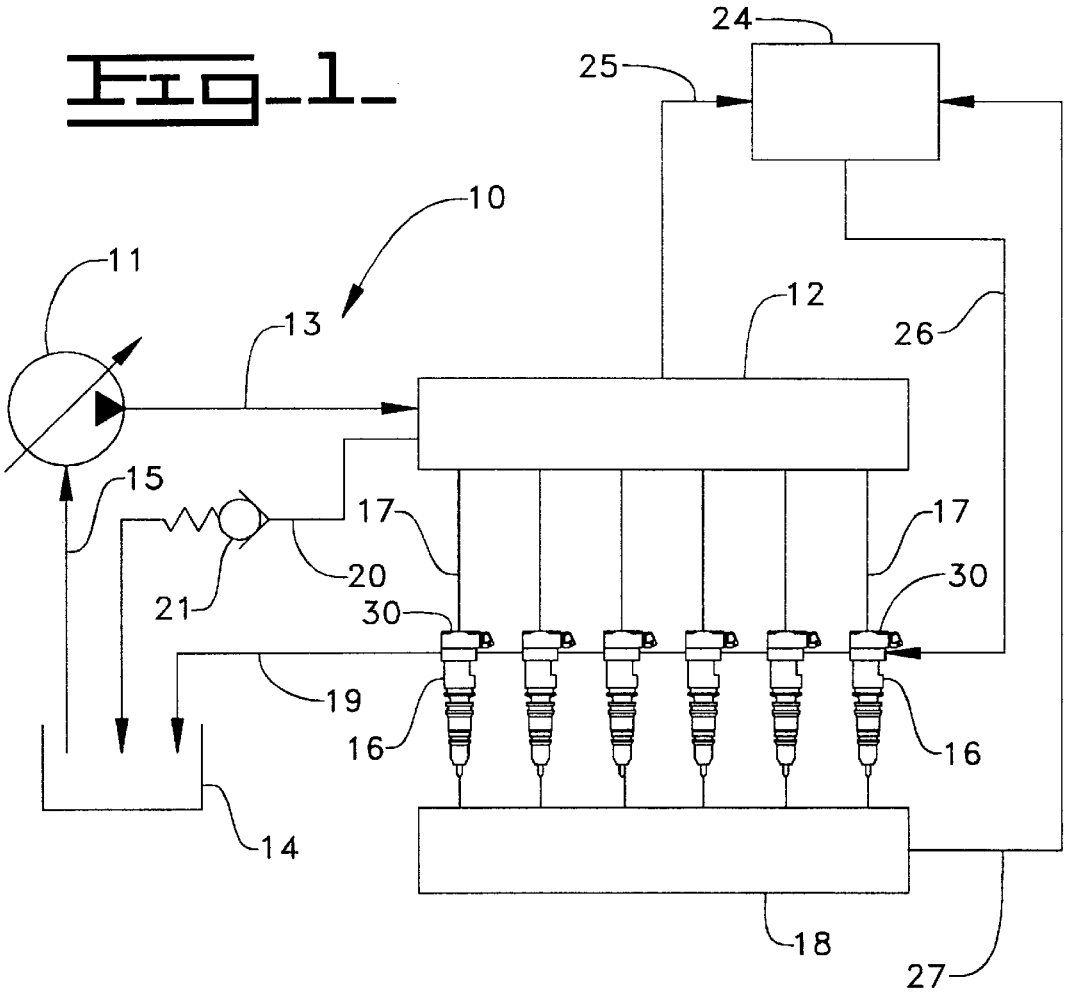
FIG. 1 is a schematic illustration of a hydraulically-actuated fuel injection system according to one embodiment of the present invention.

Referring now to FIG. 1, a hydraulically-actuated fuel injection system 10 includes a high pressure common rail 12 connected to a fixed displacement swash plate type pump 11 via a high pressure supply line 13. The plurality of hydraulically-actuated fuel injectors 16 are connected to high pressure rail 12 with individual branch passages 17. Fuel injectors 16 are appropriately positioned to inject fuel into an engine 18 that powers pump 11 via a connection not shown. After the actuation fluid performs work in the individual injectors 16, it is returned to a low pressure reservoir 14 for recirculation via a low pressure return line 19. High pressure pump 11 draws actuation fluid, which is preferably engine lubricating oil, from low pressure reservoir 14 along low pressure supply line 15. In order to prevent high pressure rail 12 from being over pressurized, a check valve 21 is provided in an over pressurization return line 20. If pressure in rail 12 exceeds a predetermined magnitude, check valve 21 opens to relieve pressure from rail 12.

Figure 2:
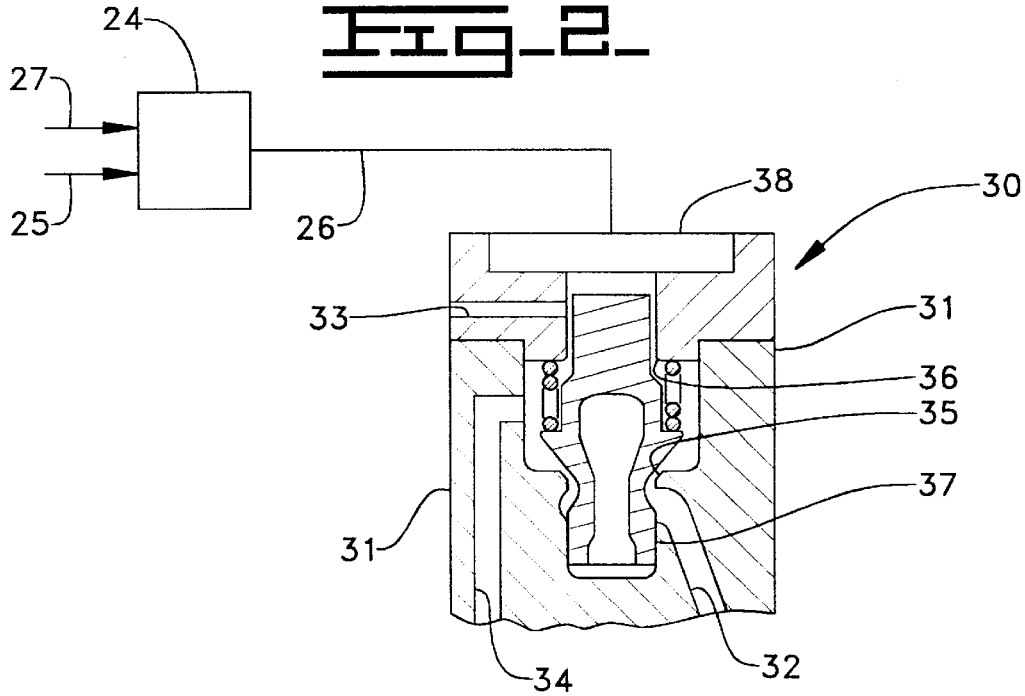
FIG. 2 is a sectioned side diagrammatic view of a control valve according to one aspect of the present invention.

Referring now in addition to FIG. 2, each of the hydraulically-actuated fuel injectors 16 of FIG. 1 includes a control valve 30 that includes a valve body 31. Valve body 31 defines a high pressure actuation fluid inlet 32 that is connected to the individual branch passages 17, and a low pressure drain port 33 connected to the low pressure return line 19. A poppet valve member 37 is positioned in valve body 31 and attached to a solenoid 38 that is mounted on valve body 31. Solenoid 38 moves poppet valve member 37 between a lower position where it is seated in high pressure seat 35 to close fluid connection between high pressure inlet 32 and internal work passage 34. When in this condition, internal work passage 34 is opened past low pressure seat 36 to low pressure drain 33. When solenoid 38 is energized, poppet valve member 37 lifts to open high pressure seat 35 and close low pressure seat 36. When in this condition, high pressure inlet 32 is opened to internal work passage 34 past high pressure seat 35.

FIG. 2 shows poppet valve member 37 in an intermediate position between its upper and lower seated positions. In this partially open area, high pressure inlet 32 is opened directly to low pressure drain 33 past high pressure seat 35 and low pressure seat 36. The distance that poppet valve member 37 must travel between high pressure seat 35 and low pressure seat 36 in its normal operation is shown greatly exaggerated in FIG. 2. In one specific example, poppet valve members of prior art hydraulically-actuated fuel injectors generally move on the order of about 250 microns between their low pressure and high pressure seats. In general, when the hydraulically-actuated fuel injectors 16 are performing their normal operations, the amount of time that poppet valve member is in an intermediate position between its high pressure and low pressure seats is relatively brief. By appropriately pulsing solenoid 38, poppet valve member 37 can be made to move to a partially open position that allows some high pressure fluid to flow directly through control valve 30 from high pressure inlet 32 to low pressure drain 33 without causing pressure in the fuel injector to rise sufficiently to cause fuel to be injected.

Figure 3:
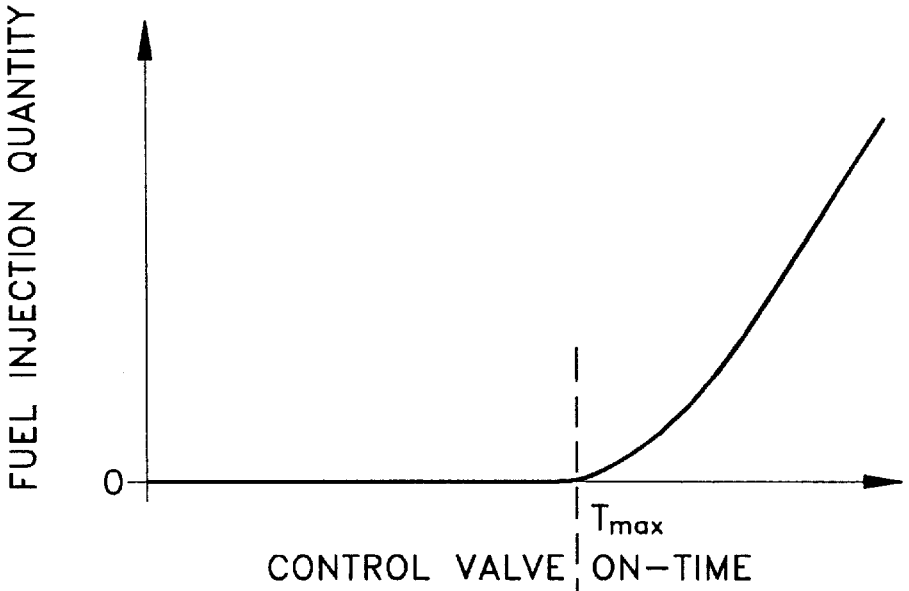
FIG. 3 is a graph of fuel injection quantity versus control valve on-time for a hydraulically-actuated fuel injector according to one aspect of the present invention.
Figure 4:
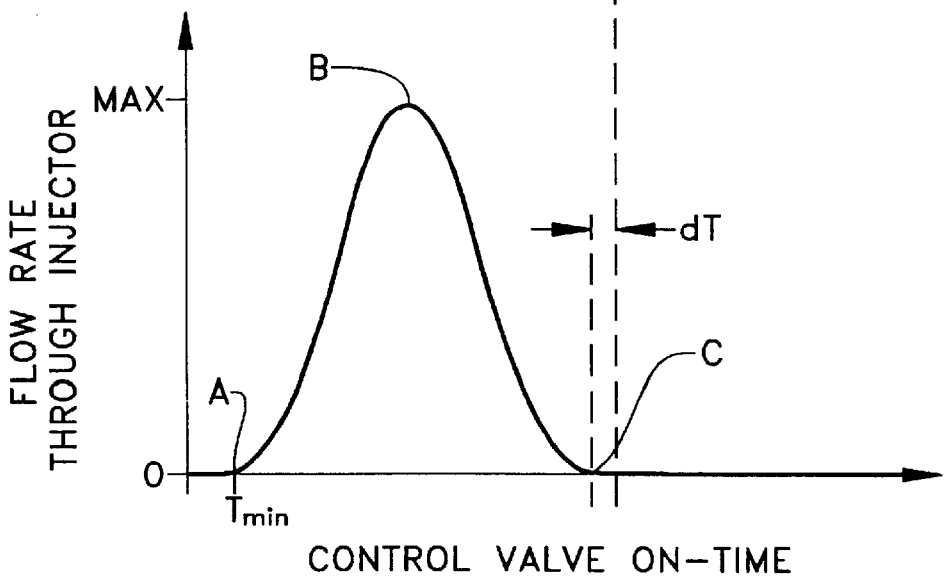
FIG. 4 is a graph of flow rate through the injector versus control valve on-time according to another aspect of the present invention.

Referring now in addition to FIGS. 3 and 4, the minimum and maximum amount of time that the control valve can be turned on and still achieve the pressure regulation goals of the present invention are illustrated. For instance, if the solenoid 38 has an on-time less than Tmin corresponding to point A on FIG. 4, the poppet valve member 37 does not even move. In other words, if the amount of time that the solenoid is turned on is so brief, literally nothing happens. If solenoid 38 is on for an amount of time greater than Tmax (see FIG. 3) then at least a minimum injection event will occur. The point B of FIG. 4 corresponds to when poppet valve member 37 is about halfway between high pressure seat 35 and low pressure seat 36, such that the flow area between high pressure inlet 32 and low pressure drain 33 is maximized. The point C of FIG. 4 corresponds to when control valve 30 has been on sufficiently long that poppet valve member 37 has moved completely up to close low pressure seat 36. The time delay dT between point C and the time Tmax corresponds to the amount of time that it takes for pressure to build in the fuel injector before fuel commences to spray into the engine. In some cases, the time dT is negative such that injection begins before the drain is fully closed. Thus, as long as control valve 30 is energized for an amount of time greater than Tmin but less than Tmax, an amount of actuation fluid will flow directly through fuel injector 16 without actually causing an injection event. Any amount of fuel that flows through control valve 30 will cause a corresponding slight drop in pressure within high pressure rail 12. Thus, in terms of the present invention, a pressure regulation event takes place whenever the control valve is activated for a time greater than Tmin but less than Tmax. An injection event takes place whenever the control valve is actuated for a time greater than Tmax.

INDUSTRIAL APPLICABILITY

Hydraulically-actuated system 10 is controlled in its operation by a conventional electronic control module 24 that receives fluid pressure sensor measurements from high pressure rail 12 via sensor communication line 25, and receives engine load and speed data from engine 18 via an operating condition communication line 27. Electronic control module 24 schedules and commands fuel injector 16 to perform injection events through a control communication line 26 that supplies current to solenoid 38. Injection events are scheduled, commanded and performed in a manner substantially identical to known prior art hydraulically actuated fuel injection systems.

Figures 5A, 5B, 5C:
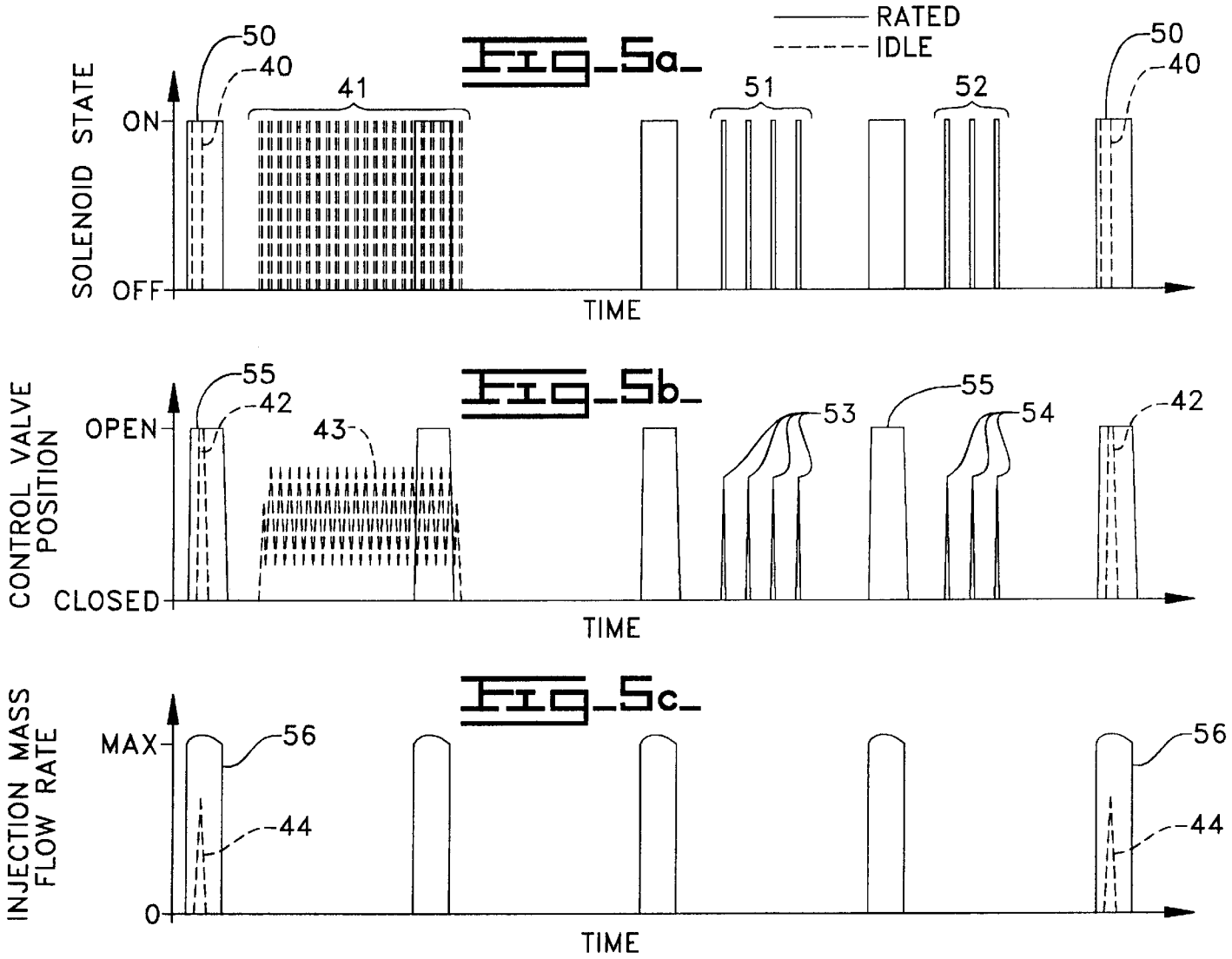
FIGS. 5*a–c* are graphs of solenoid state, control valve position and injection mass flow rate, respectively, versus time for a single hydraulically-actuated fuel injector over a plurality of idle and rated injection cycles according to the present invention.

Referring now to the rated operating condition curves of FIGS. 5*a–c*, the electronic control module 24 periodically commands an injection event 50 for each individual injector. The present invention seeks to exploit the relatively large amount of idle time between injection events to perform pressure regulation events in order to control fluid pressure in high pressure rail 12. In the prior art, during a majority of the time between fuel injection events, the individual fuel injectors 16 set idle. Nevertheless, those skilled in the art will appreciate that some amount of time between injection events is devoted to resetting into individual fuel injector for a subsequent injection event.

In this example, electronic control module 24 senses that fluid pressure in high pressure rail 12 has become too high between the third and fourth rated fuel injection events of FIG. 5*a*. In order to lower the pressure in rail 12, a sequence of four pressure regulating events 51 are performed. During pressure regulation events 51, the solenoid is briefly pulsed for an amount of time greater than Tmin of FIG. 4 but less than Tmax of FIG. 3 so that the control valve moves to a partially open position 53 as shown in FIG. 5*b*. During an injection event, control valve movement 55 is significantly different from the control valve movement 53 during a pressure regulating event. FIG. 5*c* illustrates that no fuel injection occurs during the pressure regulating events 51, yet a substantial amount of fuel 56 is injected in the regularly scheduled injection events. In this example, a second series of pressure regulating events 52 occur between the fourth and fifth injection events 50. As in the previous pressure regulating events, the control valve moves to a partially open position 54 as shown in FIG. 5*b*.

While the rated condition operation described above might correspond to an engine operating condition on the order of about 2400 rpm, the idle conditions illustrated in FIGS. 5*a–c* could correspond to an engine operating condition on the order of about 600 rpm, or about one-quarter of the speed of the rated condition. Since the engine is operating much slower at an idle condition, there is a significantly larger amount of time between idle injection events 40 than between the rated fuel injection events 50. Each idle injection event 40 corresponds to a brief control valve movement 42 that is sufficient to cause a relatively small idle injection event 44 to take place.

In this example, a single relatively long pressure regulating event 41 occurs after the first idle injection event. Pressure regulation event 41 causes the control valve 43 to remain in a partially open position 43 during the complete event. This is accomplished by pulsing the solenoid 38 in a series for brief amounts of time, and spacing those pulses an amount of time apart that causes the poppet valve member to hover between its upper and lower seats. When this is occurring a substantial amount of pressurized fluid can be dumped from the high pressure rail. This relatively large dumping of pressure from high pressure rail 12 might be desirable, for instance, when the engine is quickly dropping from a rated condition down to an idle condition. FIG. 5*c* illustrates that even though the control valve is maintained in a partially open position, no injection of fuel takes place since the fluid flow through the control valve prevents the buildup of pressure in the injector necessary to cause an injection event to occur.

Those skilled in the art will appreciate that all of the fuel injectors have an idle time between their respective injection events. Thus, while one injector is performing an injection event, the remaining fuel injectors are idle and can be performing pressure regulating events in order to maintain high pressure rail 12 at a desired pressure. In order to accomplish this, it might be necessary to modify the hydraulically-actuated system 10 from that of the prior art so that the system has the ability to supply adequate current to a plurality or all of the available fuel injectors simultaneously. In prior art systems, typically only one or possibly two fuel injectors are activated at any given time.

Those skilled in the art will appreciate that any pressure sensor attached to high pressure rail 12 will see pressure fluctuate due to a number of factors including pump characteristics and due to fluid consumption through the normal operation of the individual fuel injectors. Thus, electronic control module must normally calculate an average estimated fluid pressure in common rail 12 based upon these measurements. As long as the average estimated pressure is within some predetermined range of a desired pressure, no pressure regulating events will be commanded. However, if fluid pressure in the rail is too high, one or more idle fuel injectors can be commanded to perform pressure regulating events to bring the fluid pressure in the rail closer to a desired pressure. The present invention permits the elimination of the electronically controlled rail pressure control valve of the prior art. In addition, the invention permits the use of a relatively smaller pump since its output can be more closely matched to the demand of the fuel injectors than that possible with the continuous pressure spill regulation scheme of the prior art.

Those skilled in the art will appreciate that the above description is intended for illustrative purposes only, and is not intended to limit the scope of the present invention in any way. For instance, while the hydraulically actuated system of the present invention has been illustrated in relation to hydraulically-actuated fuel injectors, other hydraulically-actuated devices, such as exhaust brake actuators or gas exchange valve actuators could be substituted, without otherwise altering the operation of the present invention. In addition, other control valve types, such as those including spool valve members, could perform the pressure regulating events of the present invention without otherwise altering the regular performance of the individual hydraulic devices. Thus, various modifications could be made to the illustrated embodiment without departing from the spirit and scope of the present invention, which is defined in terms of the claims set forth below.

I claim:

1. A method of regulating pressure in a hydraulically actuated system attached to an engine, comprising the steps of:

providing a hydraulically actuated system having a high pressure pump coupled to an engine and connected to a high pressure rail that is connected to a hydraulically actuated device that includes a control valve;

periodically activating said control valve sufficiently to operate said hydraulically actuated device for an operation event;

determining a fluid pressure in said high pressure rail;

if said fluid pressure is too high and said hydraulically actuated device is between operation events, then activating said control valve for a pressure regulation event that is insufficient for said hydraulically actuated device to perform a minimum operation event.

2. The method of claim 1 wherein said hydraulically actuated device is a fuel injector, and said operation event is an injection event; and said control valve is activated for a series of pressure regulation events between said injection events.

3. The method of claim 1 wherein said determining step includes the steps of:

estimating said fluid pressure in said high pressure rail; and comparing said fluid pressure to a desired pressure.

4. The method of claim 3 wherein said estimating step includes a step of measuring said fluid pressure in said high pressure rail.

5. The method of claim 1 wherein said pressure regulation event includes maintaining said control valve in a partially open position.

6. The method of claim 1 wherein said pressure regulation event is begun after said hydraulically actuated device is reset for a subsequent operation event.

7. A method of regulating pressure in a hydraulically actuated fuel injection system, comprising the steps of:

providing a hydraulically actuated fuel injection system having a high pressure pump coupled to an engine and connected to a high pressure rail that is connected to a plurality of hydraulically actuated fuel injectors that each include a control valve;

periodically activating said control valve sufficiently to perform an injection event;

determining a fluid pressure in said high pressure rail;

identifying an idle fuel injector that is between injection events;

if said fluid pressure is too high, then activating said control valve of said idle fuel injector for a pressure regulation event that is insufficient for said idle fuel injector inject fuel.

8. The method of claim 7 wherein said control valve is partially open during said pressure regulation event.

9. The method of claim 8 wherein said control valve of said idle injector is activated for a plurality of pressure regulation events between said injection events.

10. The method of claim 9 wherein said pressure regulation event is begun after said idle fuel injector is reset for a subsequent injection event.

11. The method of claim 10 wherein a plurality of idle fuel injectors are identified; and said plurality of idle fuel injectors perform pressure regulation events at about the same time.

12. The method of claim 11 wherein said determining step includes the steps of:

estimating said fluid pressure in said high pressure rail; and comparing said fluid pressure to a desired pressure.

13. The method of claim 12 wherein said estimating step includes a step of measuring said fluid pressure in said high pressure rail.

14. A method of operating a hydraulically actuated fuel injection system comprising the steps of:

providing a hydraulically actuated fuel injection system having a high pressure pump coupled to an engine and connected to a high pressure rail that is connected to a plurality of hydraulically actuated fuel injectors that each include a control valve;

determining an engine operating condition;

scheduling injection events based upon said engine operating condition;

periodically activating said control valve of at least some of said fuel injectors for an amount of time sufficient to perform said injection events;

determining a fluid pressure in said high pressure rail;

identifying an idle fuel injector that is between injection events;

if said fluid pressure is too high, then activating said control valve of said idle fuel injector for a pressure regulation event that is insufficient for said idle fuel injector to inject fuel.

15. The method of claim 14 wherein said determining step includes the steps of:

estimating said fluid pressure in said high pressure rail; and comparing said fluid pressure to a desired pressure.

16. The method of claim 14 wherein said pressure regulation event includes pulsing said control valve to a partially open state.

17. The method of claim 14 wherein said control valve of said idle injector is activated for a plurality of pressure regulation events between two injection events.

18. The method of claim 14 wherein said pressure regulation event is begun after said idle fuel injector is reset for a subsequent injection event.

19. The method of claim 14 wherein, if said operating condition corresponds to a relatively low demand condition, then a portion of said fuel injectors perform said injection events, and a different portion perform said pressure regulation events; and if said engine operating condition corresponds to a relatively high demand condition, then all of said fuel injectors perform said injection events.

20. The method of claim 14 wherein said pressure regulation event is only performed if said idle fuel injector is reset for a subsequent injection event.

* * * * *